United States Patent [19]

Dawson

[11] 4,264,249

[45] Apr. 28, 1981

[54] TORIC SURFACE GENERATOR

[75] Inventor: W. Clifford Dawson, E. Woodstock, Conn.

[73] Assignee: American Optical Corporation, Southbridge, Mass.

[21] Appl. No.: 69,402

[22] Filed: Aug. 24, 1979

[51] Int. Cl.[3] ..... B23C 3/04; B23C 3/16

[52] U.S. Cl. ..... 409/199; 409/166; 409/316; 82/12; 51/124 L

[58] Field of Search ..... 409/313, 315, 316, 317, 409/199, 200, 211, 162, 168, 166; 51/33 W, 55, 124 L, 105 L; 82/12

[56] References Cited

U.S. PATENT DOCUMENTS

| | | | |
|---|---|---|---|
| 1,580,006 | 4/1926 | Brown | 409/316 |
| 1,711,801 | 5/1929 | McCabe | 82/12 X |
| 2,548,418 | 4/1951 | Bernheim et al. | 51/55 |
| 2,633,675 | 4/1953 | Ellis | 51/33 |
| 2,724,218 | 11/1955 | Dillon et al. | 51/55 |
| 3,117,396 | 1/1964 | Dalton | 51/33 |
| 3,492,764 | 2/1970 | Dalton | 51/288 |
| 3,624,969 | 12/1971 | Dalton | 51/131 |
| 3,670,460 | 6/1972 | Oldfield et al. | 51/124 L |

*Primary Examiner*—Leonidas Vlachos

*Attorney, Agent, or Firm*—Jeremiah J. Duggan; Alan H. Spencer

[57] ABSTRACT

Generating lens surfaces to true toric shapes with lens surfacing machinery employing a cutting tool having a single cutting edge and provision for universal adjustment of its effective cutting radius.

7 Claims, 2 Drawing Figures

TORIC SURFACE GENERATOR

BACKGROUND OF THE INVENTION

1. Field of the Invention

This invention relates to lens surfacing apparatus and has particular reference to improvements in toric surface generators.

2. Discussion of the Prior Art

A toric surface is a surface of compound curvature frequently used ophthalmically for the correction of astigmatism. By compound curvature it is meant that the radius of curvature in one meridian is different than the radius of curvature in a second orthogonal meridian.

Because of the large commercial and practical importance of toric surfaces, a number of techniques have developed for their production. An early technique involved the use of preformed tools each having the shape of a particular toric curve desired on a lens, i.e. a mirror image of the desired lens surface shape. This preformed tool was abraded against the lens surface in conjunction with abrasive slurries in such a way that gradually the lens assumed the shape of the tool. This produced reasonably accurate toric surfaces. However, because of rapid tool wear and the vast inventory of preformed tools needed to satisfy the hundreds of combinations of the two meridianal radii of curvature encountered in the field, preformed tools have been largely replaced by a rotating cupped or ring tool. This tool typically has an annular working edge which abrades the workpiece, be it glass or plastic. The toric surface is achieved by having the radius through which the ring tool is swung be substantially the same as one of the desired radii of lens surface curvature. The second radius of curvature in a meridian at right angles to the first is achieved by a tilt of the ring tool so that the profile of the tool assumes approximately the curvature of the second radius. The universal nature of being able to modify independently both the radius of swing and the angle of tool tilt eliminates the need for large tool inventory. Unfortunately, in the process of using the angle of tilt to modify one effective tool cutting radius, an eliptical error is introduced so that the lens surface formed is not a true toroid. This eliptical error is in most cases very significant. It requires subsequent surface grinding to eliminate if one is to achieve optimum lens performance.

A number of attempts have been made to overcome the problems associated with undesirable eliptical error. In one case, the eliptical error was minimized by moving the tool relative to the lens in a series of complex motions which necessitated correspondingly complex and expensive machinery not suitable for use in custom laboratory operations. More recent attempts used a grinding tool which was swung through one of the desired radii of curvature with its own radius of curvature being that of the second radius of curvature desired on the lens. This, however, necessitates a separate tool for each second radius of curvature and hence, still requires costly tool inventory. Such a need for large tool inventory has, however, been reduced by still using the aforementioned cupped or ring tool which is swung through one radius with the orthogonal tool profile assuming the curve along a second meridian which is simultaneously modified with an oscillating motion of the lens relative to the tool. Although theoretically capable of producing desired surface curves, this scheme is extremely cumbersome and difficult to implement and lacks the rigidity necessary for successful use.

Examples of the above toric generating schemes and apparatuses can be found in U.S. Pat. Nos. 2,548,418; 2,633,675; 2,724,218; 3,117,396; 3,492,764 and 3,624,969.

With a view to overcoming the above and related shortcomings of the prior art, it is an object of this invention to simplify the manufacture of true toric surfaces and more particularly to avoid eliptical error defects in ophthalmic lens surfaces intended for the correction of astigmatism.

Another object is to accomplish the foregoing with minimal capital equipment expenditure.

Still another object is to provide an apparatus for generating true toric lens surfaces, a single tool universality to the production of various preselected combinations of spherical and cylinder curvatures.

A further object is to provide toric surface generating apparatus of minimal mechanical complication and costliness and requiring no special skills to operate.

Other objects and advantages of the invention will become apparent from the following description.

SUMMARY OF THE INVENTION

The foregoing objects and corollaries thereof are accomplished with a rotatable tool head and single cutting tool, the cutting edge or point of which has a radius of travel about the axis of rotation of the head which is equal to a first of two orthogonal radii desired of a toric surface to be generated. The rotatable cutter head is further arranged to be swung about an axis extending perpendicularly to the axis of rotation of its tool head and spaced from the point of the tool a distance corresponding to the radius desired of the other torus curvature.

The tool head per se is further so arranged that by rotational adjustment of its tool about an axis extending right angularly through the rotational axis of the head, various effective cutting radii may be universally established for producing the aforesaid desired first of the two radii of curvature of the torus. With such universal adjustment of the cutting head and simultaneous or separate adjustment of position of the pivot axis relative to the point of the tool, a preselected combination of two orthogonal cutting radii may be established.

The toric surface to be produced is formed by swinging the cutting head with cutting tool across the workpiece surface for generating one radius of curvature while the other radius of curvature is produced by simultaneous revolving of the cutting tool about the axis of rotation of the cutting head.

Details of the invention will become more readily apparent from the following description when taken in conjunction with the accompanying drawings.

IN THE DRAWINGS

FIG. 1 is a partially cross-sectioned plan view of a preferred embodiment of the invention; and FIG. 2 is a fragmentary plan view of a portion of the lens generating apparatus of FIG. 1 wherein method of adjusting a tool cutting radius is illustrated.

DESCRIPTION OF THE PREFERRED EMBODIMENTS

Figure 1:
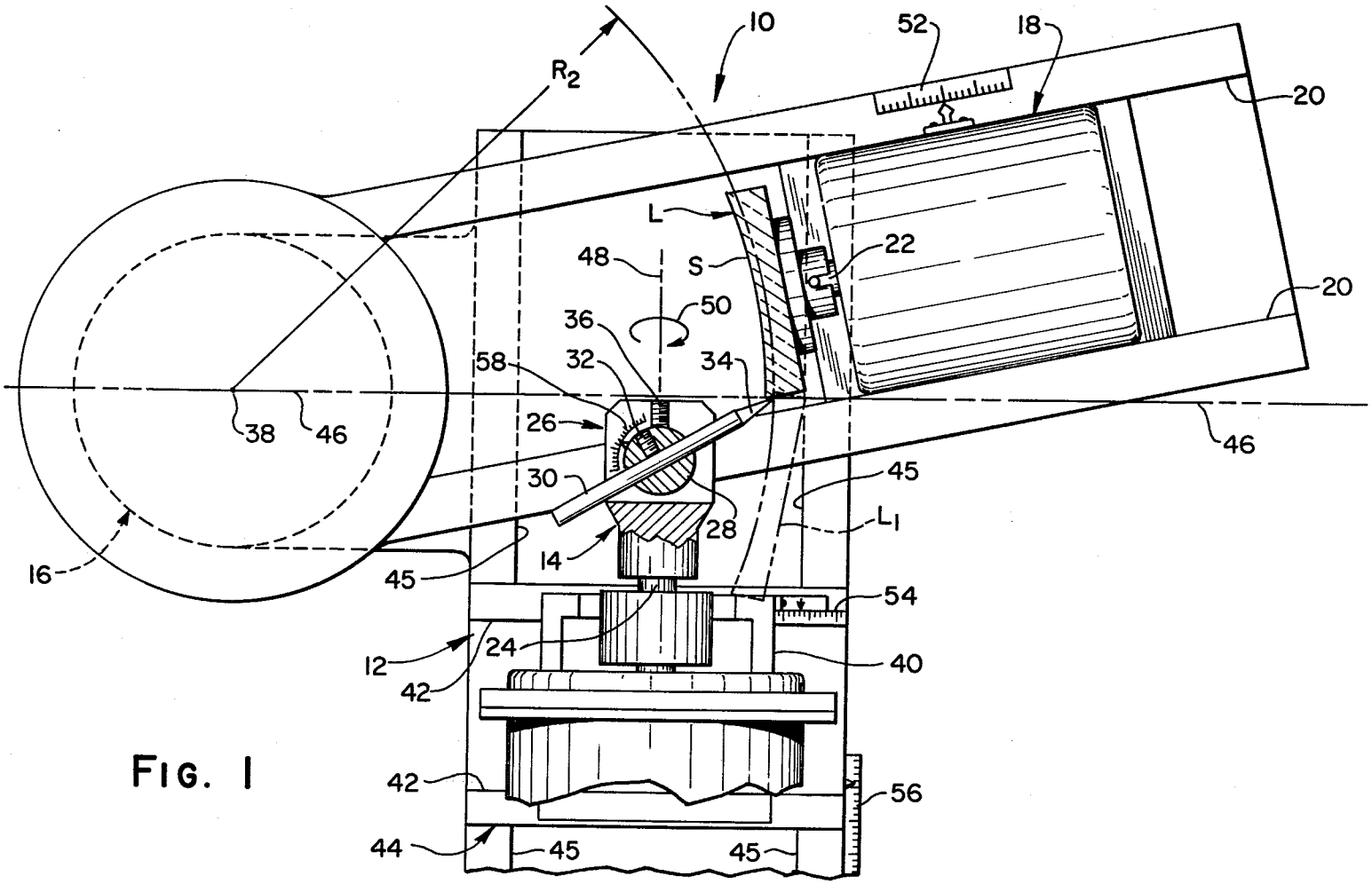

Referring to the drawings, generator 10 is comprised of machine base 12 which supports cutter head 14 and pivot post 16.

Work supporting head 18 which may be adjusted toward and away from cutter head 14 is carried by ways 20 and adaptor 22, e.g. a tapered shank, receives a conventionally or otherwise blocked lens L to be surface generated according to the invention.

Cutter head 14 includes motor driven spindle 24 which supports tool carrier 26. Carrier 26, in turn, is provided with tool post 28 and tool 30 is extended diametrically through post 28 toward lens L. Clamp screw 32 is used to fix tool 30 with its effective cutting edge, i.e. tip 34, at a desired distance from post 28. With such a setting of tool 30 in post 28 and rotational adjustment of post 28 about its axis, there may be established a given radius of curvature $R_1$ (FIG. 2) about which tip 34 will rotate with rotation of carrier 26. Clamp screw 36 is tightened when all adjustments for establishing the aforesaid radial distance $R_1$ are completed.

Referring again to FIG. 2, it can be seen that the structure of tool carrier 26 provides for universal adjustment of radial distance $R_1$. For example, when tool 30 is rotated to the position depicted with broken lines $30_a$, $R_1$ becomes shorter as shown by arrow $R_{1a}$. When tool 30 is rotated to the position of $30_b$, $R_1$ becomes longer as shown by arrow $R_{1b}$.

With the setting of distance $R_1$ which represents the radius of curvature desired to be provided in one meridian (e.g. the cylinder meridian) of a surface S of lens L, the other radius of curvature $R_2$ (FIG. 1) to be produced orthogonally (e.g. in the spherical meridian) is established by adjusting tool carrier 26 toward or away from axis 38 of pivot post 16 by movement of slide 40 along ways 42 on base slide 44. Radius $R_2$ corresponds to the distance from tip 34 of tool 30 to axis 38 of pivot post 16 and its setting is preferably established after the aforesaid angular setting of tool 30 in carrier 26. The effective cutting edge of tip 34 is preferably positioned on a line 46 which is perpendicular to the axis of rotation 48 of tool carrier 26 and intersects axis 38 of pivot post 16. This is accomplished with movement of base slide 44 as needed along ways 45 of machine base 12.

Surface S of lens L is generated to a true toric shape of cylinder radius $R_1$ and spherical radius $R_2$ by bringing lens L into working contact with tool 30.

This may be accomplished by initially moving work supporting head 18 toward tool 30 along ways 20 to the point of bringing the uncut lens surface S beyond tip 34 a distance equal to the depth of cut desired. This setting of the work supporting head may be effected prior to rotating tool carrier 26 or by feeding surface S of lens L into tool 30 while rotating the tool carrier as indicated by arrow 50 (FIG. 1).

By means of gib locks or their equivalents which are well known to the artisan and do not require showing herein, work supporting head 18, tool carrier slide 40 and base slide 44 are locked in the aforesaid adjusted positions before commencing generation, i.e. cutting, of surface S of lens L.

It should be understood that vernier scales 52 and 54 may also be incorporated in the sliding mechanisms of head 18 and tool carrier 26 to facilitate proper setting thereof before locking. A similar vernier scale 56 may be provided for aiding in the setting of base slide 44 for tool carrier 26 on machine base 12. Likewise, manual rotational adjustment and setting of tool post 28 can be facilitated by circular vernier scale 58.

Figure 2:
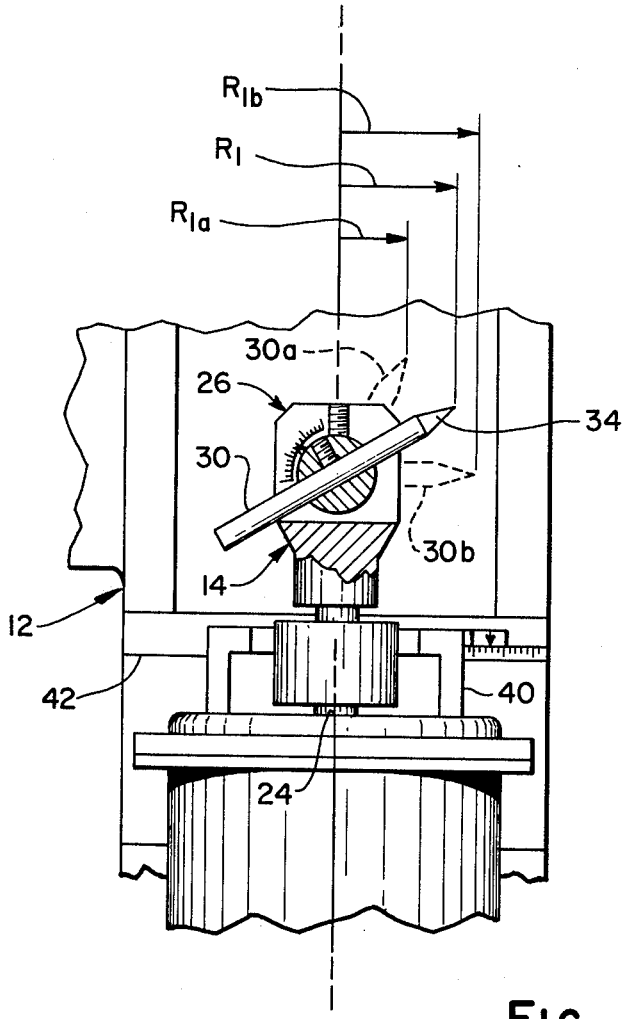

Additionally, while not shown, motor driven mechanisms operating under data input from computer or microprocessor means may be incorporated in the apparatus of FIGS. 1 and 2 for automatically performing the adjustments of tool and work supporting heads and/or rotation of tool post 30.

An alternative to the movement of work supporting head toward tool 30 for establishing the aforesaid lens/-tool setting and working relationship may be an arrangement for moving the entire system of tool carrier 26 and pivot post 16 as a unit along a machine base toward and away from supporting head 18 which would be fixed upon the machine base.

With workpiece (lens L) and tool 30 in the working relationship shown in FIG. 1, the generating of surface S to a true toric shape with continuous rotation of tool 30 about axis 48 is accomplished by swinging lens L clockwise as viewed in FIG. 1 about axis 38 of pivot post 16 to the position shown with broken line illustrated and labelled $L_1$. This is effected by manually swinging or motor driving head 18 and ways 20 as a unit pivotally about post 16. Alternatively, generator 10 may be designed so that tool carrier 26 and its associated mechanisms are themselves pivotable as a unit about axis 38 while work supporting head 18 is held stationary on the machine base during a lens surface generating operation.

Generator 10 is adaptable to the surfacing of glass or plastic workpieces with proper selection of cutting tip 34. For example, the surfacing of a lens L formed of glass can best be accomplished with a diamond cutting tip while carbides and tool steel will suffice for the cutting of plastic lenses such as those formed of a polycarbonate or cast allyl diglycol carbonate. For superior finish and cutting effect in the working of either glass or plastic, however, tool cutting edge inserts formed of natural or synthetic diamonds or sintered diamonds are suggested. Natural single crystal or polycrystalline diamonds are preferred.

While the description of generator 10 has thus far referred to the cutting of toric curvatures on workpieces of glass or plastic, it should be appreciated that by rendering radial distances $R_1$ and $R_2$ equal, the resulting generated surface S would be spherical in shape. Alternatively, with any convenient setting of distance $R_1$ and rotation of lens L about its axis during the above rotation of tool 30 and swinging of lens L past tip 34, a spherical surface may be produced upon the lens.

Those skilled in the art will readily appreciate that various modifications and adaptations of the precise forms of the invention described above may be made to suit particular requirements. For example, if it is desired to swing tool 30 and its entire supporting mechanism about the circular path of radius $R_2$ rather than work supporting head 18, base 12 of generator 10 would preferably be positioned beneath head 18 for fixedly supporting both pivot post 16 and head 18 while the aforesaid tool 30 supporting mechanism is carried by post 16. Accordingly, it is intended that all modifications which incorporate the novel concept disclosed are to be construed as coming within the scope of the appending claims or the range of equivalency to which they are entitled in view of the prior art.

I claim:

1. Lens surfacing apparatus comprising:

a machine base;

an independently axially rotatable cutter head having a pivotal tool post;

means for rotating said cutter head about its axis;

a cutting tool extended diametrally through said tool post and said post having an axis extending orthogonally through said axis of rotation of said cutter head wherewith settings of predetermined amounts of extension of said tool through said post and degree of rotational adjustment of said post in said cutter head provide universality of adjustment for said tool cutting edge displacement from said axis of said cutter head, said tool having an effective cutting edge displaced from said axis of said cutter head a distance corresponding to a first of two orthogonal radii of curvatures to be cut on a surface of the lens to be worked, there being means for selectively locking both said tool in said tool post and said tool post in said cutter head at desired settings of the above adjustments;

a work-supporting head;

said cutter and work-supporting heads being mounted upon said base with one adapted to swing in a direction across the other, the radius of said swing corresponding to the second of said radii of curvature to be cut upon said lens; and means for adjusting the length of said radius of swing of said one head according to respective radii of curvature desired upon said surface of said lens.

2. Apparatus according to claim 1 including a pivot post about which said one of said heads is swung across the other and means for adjusting said cutter head toward and away from said pivot post for setting said adjusted tool edge at a radial distance from said pivot post according to said radius of swing required of said one head to produce said second radius of curvature upon said lens.

3. Apparatus according to claim 2 wherein said cutter head is mounted upon a slide and said means for adjusting said cutter head toward and away from said pivot post includes ways for guiding said slide.

4. Apparatus according to claim 2 wherein said one of said heads is said work supporting head.

5. Apparatus according to claim 2 wherein said one of said heads is said cutter head.

6. Apparatus according to claim 1 wherein said work supporting head is independently adjustable toward and away from said cutter head for establishing working contact between said lens and tool.

7. Apparatus according to claim 6 wherein said work supporting head is mounted upon a slide and said means for independently adjusting said work supporting head toward and away from said cutter head includes ways for guiding said slide.

* * * * *